United States Patent [19]

Bartelt

[11] Patent Number: 4,620,631

[45] Date of Patent: Nov. 4, 1986

[54] DEVICE FOR HOLDING CONTAINERS

[76] Inventor: Thomas P. Bartelt, 6410 Upper Parkway North, Wauwatosa, Wis. 53213

[21] Appl. No.: 743,301

[22] Filed: Jun. 10, 1985

[51] Int. Cl.[4] ..... B65D 3/28; B65D 23/12

[52] U.S. Cl. ..... 206/217; 206/218; 220/85 H; 229/1.5 H

[58] Field of Search ..... 206/216, 217, 218; 220/85 H; 229/1.5 H, 1.5 C

[56] References Cited

U.S. PATENT DOCUMENTS

| | | | |
|---|---|---|---|
| D. 139,569 | 11/1944 | O'Brien | D58/17 |
| D. 236,410 | 8/1975 | Jenkins et al. | 220/85 H |
| 1,762,331 | 6/1930 | Greist . | |
| 2,117,102 | 5/1938 | Pittler | 65/15 |
| 2,307,882 | 1/1943 | Freud et al. | 65/53 |
| 2,920,804 | 1/1960 | Minton | 229/1.5 |
| 2,965,281 | 12/1960 | Herrmann | 225/1.5 H |
| 2,979,301 | 4/1961 | Reveal | 229/1.5 H |
| 3,051,365 | 8/1962 | Sayford, Jr. | 229/1.5 H |
| 3,315,803 | 4/1967 | Kalajian | 206/217 |
| 3,397,935 | 8/1968 | Natsume | 350/17 |
| 3,926,361 | 12/1975 | Hilderbrand | 206/232 |
| 3,966,102 | 6/1976 | Clark | 224/45 |
| 4,003,491 | 1/1977 | Wells et al. | 220/23.4 |
| 4,183,444 | 1/1980 | English et al. | 220/200 |
| 4,377,234 | 3/1983 | Kaplan | 206/432 |
| 4,491,220 | 1/1985 | Daviss | 206/217 |

*Primary Examiner*—William Price
*Assistant Examiner*—Brenda J. Ehrhardt
*Attorney, Agent, or Firm*—Andrus, Sceales, Starke & Sawall

[57] ABSTRACT

A device for holding two containers, such as a beverage cup and a food container. The device is formed of a strip of flexible material and includes a pair of end sections that extend circumferentially of a first container and are bonded to the side wall of the container. The adjacent extremities of the end sections are bent radially outward and form a loop to receive and hold a second container. For storage, the loop can be folded against the first container and the loop is formed with a pull out tab, so that the folded loop can be pulled outward into a generally circular configuration to receive the second container.

4 Claims, 5 Drawing Figures

DEVICE FOR HOLDING CONTAINERS

BACKGROUND OF THE INVENTION

It is often desirable to be able to hold both a beverage cup and a food container in one hand. For example, a patron at a theater may purchase both a container of popcorn and a soft drink. As there is no facility in a theater to conveniently set down either the cup or the container down, the patron will attempt to juggle both containers in one hand, leaving the other hand free to eat the food product. This frequently results in spillage of the soft drink, or the food product, or both.

In the past holders have been devised in an attempt to enable a person to conveniently hold both a beverage and a food product in one hand. For example in U.S. Pat. No. 4,183,444, a container is attached to a drinking cup, the object being to allow a person to carry food and drink in one hand. In other cases, such as shown in U.S. Pat. No. 1,762,331 and U.S. Pat. No. Des. 139,569, small auxiliary containers are attached to the upper rim of a primary container. In U.S. Pat. No. 2,307,882, a wire-form device is attached to a plate and is capable of holding a beverage cup.

SUMMARY OF THE INVENTION

The invention is directed to an improved device for holding two containers, such as a beverage cup and a container for food product. In accordance with the invention, the device is formed of a strip of flexible paper or plastic material and includes a pair of end sections that extend circumferentially of a container and are bonded to the side wall of the container. The adjacent extremities of the end sections are bent radially outward and define a loop to receive and hold a second container.

For storage, the loop can be folded inwardly against the first container and the loop is formed with a pull out tab, so that the folded loop can be pulled outwardly into generally circular configuration to receive the second container.

In a modified form of the invention, the device is formed of a strip of flexible material which has a generally figure-8 shape composed of two loop sections connected together at a central waist. Each loop defines a tapered opening to receive a container.

The holder of the invention enables a person to carry both food and drink in one hand, thereby freeing the other hand to eat the food product.

The holder is of simple and inexpensive construction and for storage purposes can be folded so that it occupies minimum space.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

FIGS. 1–4 illustrate a holding device 1 for a pair of containers 2 and 3 which enables both containers to be carried in one hand. The larger container 2 can be adapted to hold a food product, such as popcorn, while the smaller container 3 can contain a beverage, such as a soft drink. However, the invention can be utilized to support containers or cups that contain a wide variety of different products.

Figure 3:
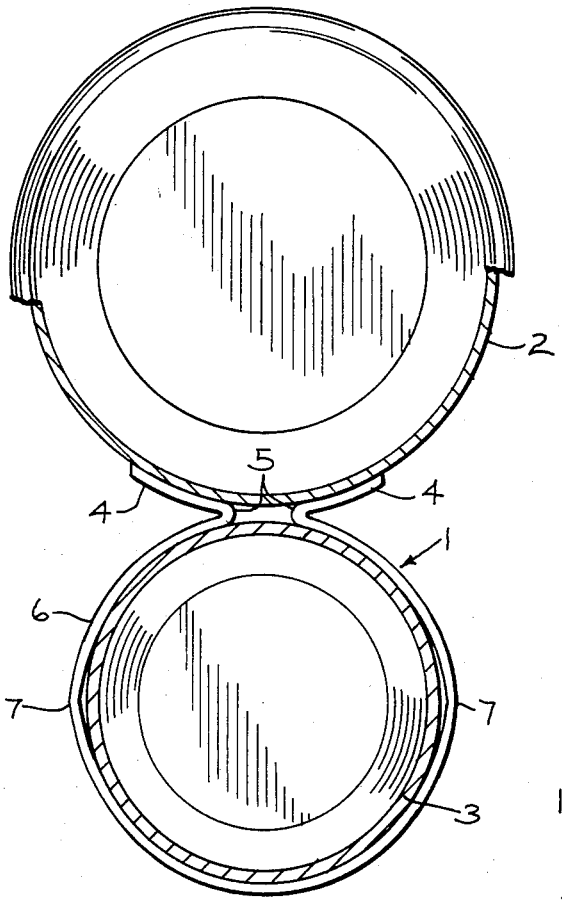
FIG. 3 is a view similar to FIG. 1 showing the holder in the operating position and supporting a second container.
Figure 4:
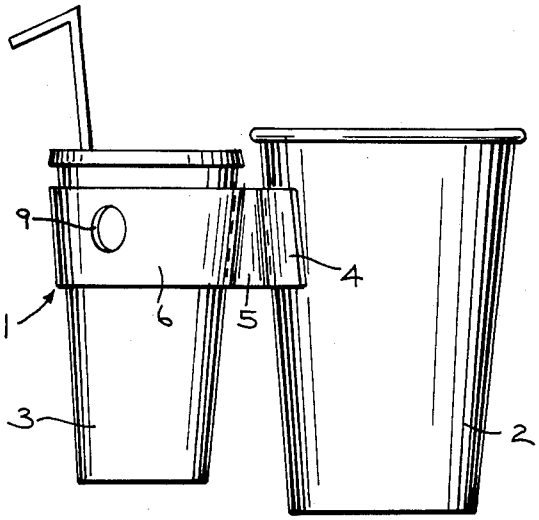
FIG. 4 is a side elevation of the construction shown in FIG. 3.

As best illustrated in FIG. 3, the holder 1 is formed of a strip of flexible material, such as paper or plastic, and has a pair of end sections 4 which are bonded to the side wall of container 2. The adjacent extremities of end sections 4 are provided with outwardly extending bent sections 5 and a generally circular loop section 6 connects the bent sections 5. As best shown in FIG. 4, the loop 6 converges downwardly to define a tapered opening that receives the second container 3.

Figure 1:
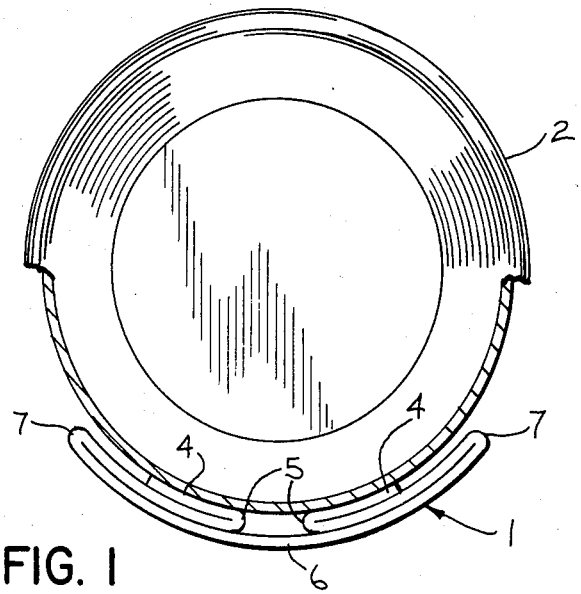
FIG. 1 is a top plan view of the holder of the invention in the folded storage position.
Figure 2:
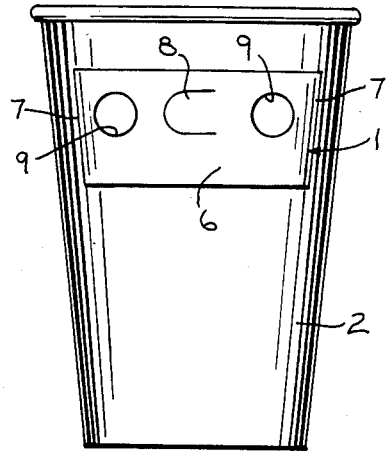
FIG. 2 is a side elevation of the construction shown in FIG. 1.

For storage purposes, loop 6 can be folded inwardly against the side wall of container 2, as illustrated in FIG. 1. In this folded condition, opposed portions of loop 6 are formed with a reverse bend as indicated by 7. To aid in unfolding the loop, a pull tab 8 can be formed in the central portion of loop 6. By pulling outwardly on tab 8, loop 6 can be unfolded to a generally circular configuration as shown in FIG. 3, to receive the container 3.

In addition, the loop 6 can be formed with a pair of spaced finger holes 9. The user may wish to hold the entire assembly through the container 3 and the finger holes will provide a better grip on the container 3.

Figure 5:
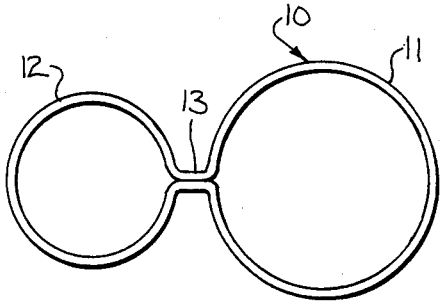
FIG. 5 is a plan view of a modified form of the invention.

FIG. 5 illustrates a modified form of the invention in which the holder 10 is formed of a strip of flexible material, such as paper or plastic, and has a generally figure-8 configuration. The holder includes a pair of interconnected loop sections 11 and 12 which are interconnected by a central waist section 13. The portions of the strip at the waist 13 are secured together to maintain the integrity of the loops 11 and 12. The loops each define a downwardly tapered opening to receive a container, such as containers 2 and 3. For storage, the device 10 can be folded with opposed portions of loops 11 and 12 being folded flatwise and extending in a common plane with central waist 13.

The holder of the invention enables two containers to be held in one hand, thereby freeing the other hand.

The holder is of simple and inexpensive construction and is capable of being folded to a storage position where it will occupy a minimum space.

Various modes of carrying out the invention are contemplated as being within the scope of the following claims particularly pointing out and distinctly claiming the subject matter which is regarded as the invention.

I claim:

1. A device for holding two products, comprising a first container to contain a product, a strip of flexible material having a pair of end sections extending circumferentially of said first container and secured to the outer surface of said first container, said strip also including a loop section and a pair of first reverse bends connecting said end sections to the respective ends of the loop section, said loop section being foldable against the container to a folded storage position, in said folded position said loop section comprising a pair of inner portions disposed flatwise against the respective end sections and said loop section also comprising an outer portion disposed flatwise against said inner portions, the ends of said outer portions being connected to said inner portions by second reverse bends, pulling outwardly on said outer portion causing said loop section to be moved from said folded position to a generally circular condition to receive a second container, said loop when in the circular condition being spaced from said first container by said first reverse bends so that said second container is spaced outwardly of said first container.

2. The device of claim 1, and including a pull tab on said loop section and disposed to be grasped by an operator to pull the loop section from the folded position to the generally circular condition.

3. The device of claim 1, and including a pair of spaced finger holes in said loop section.

4. The device of claim 1, wherein said loop section converges downwardly to provide a downwardly tapered opening to receive the second container.

* * * * *